US010468156B2

(12) United States Patent
Varkey et al.

(10) Patent No.: US 10,468,156 B2
(45) Date of Patent: Nov. 5, 2019

(54) CABLES WITH POLYMERIC JACKET LAYERS

(71) Applicant: Schlumberger Technology Corporation, Sugar Land, TX (US)

(72) Inventors: Joseph Varkey, Richmond, TX (US); Qingdi Huang, Sugar Land, TX (US); Burcu Altintas, Richmond, TX (US); Sheng Chang, Sugar Land, TX (US); Patrick Sladecek, Sugar Land, TX (US); Celso Oliveira, Pasadena, TX (US); Tam Tran, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/417,001

(22) Filed: May 20, 2019

(65) Prior Publication Data

US 2019/0279786 A1 Sep. 12, 2019

Related U.S. Application Data

(63) Continuation of application No. 15/339,326, filed on Oct. 31, 2016, now Pat. No. 10,297,365.

(51) Int. Cl.

| | |
|---|---|
| ***H01B 7/04*** | (2006.01) |
| ***H01B 7/22*** | (2006.01) |
| ***H01B 7/18*** | (2006.01) |

(52) U.S. Cl.

CPC ..... *H01B 7/046* (2013.01); *H01B 7/188* (2013.01); *H01B 7/226* (2013.01)

(58) Field of Classification Search

CPC ..... H01B 7/046; H01B 7/188; H01B 7/226; H01B 7/184

See application file for complete search history.

(56) References Cited

U.S. PATENT DOCUMENTS

| | | | | |
|---|---|---|---|---|
| 2,583,026 A * | 1/1952 | Swift | H01B 7/188 | 156/209 |
| 4,514,036 A * | 4/1985 | McDonald | B32B 27/08 | 174/107 |
| 5,990,419 A * | 11/1999 | Bogese, II | H01B 7/184 | 174/113 AS |
| 6,417,457 B1 * | 7/2002 | Aasbo | H01B 7/184 | 174/120 R |
| 6,906,264 B1 * | 6/2005 | Grant, Jr. | H01B 7/366 | 174/102 D |
| 2002/0011346 A1 * | 1/2002 | Grogl | H01B 7/187 | 174/102 R |

(Continued)

*Primary Examiner* — William H. Mayo, III
*Assistant Examiner* — Rhadames Alonzo Miller
(74) *Attorney, Agent, or Firm* — Eileen Pape

(57) ABSTRACT

The present disclosure relates to a cable that includes a core, a first armor wire layer surrounding the core, a first polymer layer disposed around the first armor wire layer, where the first polymer layer has a first sensitivity to energy emitted from an energy source, a second armor wire layer that may be disposed at least partially in the first polymer layer, and a second polymer layer disposed around the second armor wire layer, where the second polymer layer has a second sensitivity to the energy emitted from energy source, and the second sensitivity is greater than the first sensitivity.

9 Claims, 9 Drawing Sheets

(56) References Cited

U.S. PATENT DOCUMENTS

2002/0100604 A1* 8/2002 Spruell ..... H01B 7/184 174/120 R
2002/0108773 A1* 8/2002 Ware ..... H01B 7/184 174/120 R
2002/0129967 A1* 9/2002 Fett ..... H01B 7/184 174/112
2003/0062188 A1* 4/2003 Ware ..... H01B 7/184 174/110 R
2004/0256139 A1* 12/2004 Clark ..... H01B 11/002 174/110 R
2005/0006132 A1* 1/2005 Clark ..... H01B 7/184 174/113 C
2005/0133246 A1* 6/2005 Parke ..... H01B 7/184 174/113 R
2006/0242824 A1* 11/2006 Varkey ..... H01B 13/26 29/825
2007/0280611 A1* 12/2007 Dyer ..... G02B 6/4427 385/104
2009/0089998 A1* 4/2009 Varkey ..... H01B 13/24 29/825
2011/0168288 A1* 7/2011 Axelrad ..... C08L 71/00 138/118
2012/0261017 A1* 10/2012 Christensen ..... F16L 11/10 138/137
2013/0025906 A1* 1/2013 Efraimsson ..... H01B 9/02 174/102 R
2013/0048338 A1* 2/2013 Suzuki ..... C08J 3/24 174/120 R
2013/0126209 A1* 5/2013 Heffner ..... H01B 11/06 174/113 R
2014/0102749 A1* 4/2014 Varkey ..... H01B 7/046 174/102 R
2015/0136440 A1* 5/2015 Varkey ..... H01B 7/046 174/107
2015/0302953 A1* 10/2015 Efraimsson ..... H01B 7/188 174/70 R
2016/0042834 A1* 2/2016 Lackinger ..... H01B 7/0045 174/110 R
2018/0122533 A1 5/2018 Varkey et al.

* cited by examiner

CABLES WITH POLYMERIC JACKET LAYERS

CROSS REFERENCE TO RELATED APPLICATION

This application is a continuation of co-pending U.S. patent application Ser. No. 15/339,326, entitled "Cables with Polymeric Jacket Layers," filed Oct. 31, 2016, which is herein incorporated by reference in its entirety for all purposes.

BACKGROUND

This disclosure relates to cables, such as wireline cables that may convey a downhole tool in a wellbore, that include polymeric jacket layers having compositions and/or shapes that reduce or eliminate voids that could form inside the cables.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of any kind.

Numerous well-logging tools may be used to identify characteristics of a well drilled into a geological formation. These may include electrical, mechanical, electromagnetic, and/or magnetic measurements. The measurements may be transformed to identify petrophysical properties such as porosity, permeability, relative proportions of water and hydrocarbons, and so forth, which may provide highly valuable information to human operators that manage the well.

Well-logging tools may be deployed into a well using a wireline cable that may support the well-logging tool as it extends into the well. The wireline cable may include a cable that may supply power to and/or to otherwise establish a connection with the well-logging tool. For example, the cable may include a coaxial cable, a monocable, a quad-cable, a heptacable, an electric submersible pump (ESP) cable, seismic cables, permanent monitoring cables, and/or any other suitable cable that may be coupled to the well-logging tool and utilized to supply power and/or to transport data. The wireline cable may also include one or more armor wire layers that can withstand an axial force caused by a weight of the well-logging tool, as well as the wireline cable itself, as the well-logging tool extends deeper into the well. Unfortunately, in some wireline cables, the armor wire layers and/or individual armor wires may contact one another, thereby creating interstitial voids that enable gases and/or fluids to enter the wireline cable. Such gases and/or fluids may reduce the robustness of the wireline and/or interfere with a transmission of power or data through the wireline.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a cable that includes a core, a first armor wire layer surrounding the core, a first polymer layer disposed around the first armor wire layer, where the first polymer layer has a first sensitivity to energy emitted from an energy source, a second armor wire layer that may be disposed at least partially in the first polymer layer, and a second polymer layer disposed around the second armor wire layer, where the second polymer layer has a second sensitivity to the energy emitted from energy source, and the second sensitivity is greater than the first sensitivity.

The present disclosure also relates to a non-uniform polymer layer for a wireline cable that includes a base portion that may be disposed about a first armor wire layer surrounding a core of the wireline cable; and a plurality of protrusions extending radially outward from the base portion and that may receive a second armor wire layer of the wireline cable, where the plurality of protrusions may be exposed to energy emitted from an energy source before the base portion, such that the plurality of protrusions at least partially melt and the base portion remains substantially solidified upon exposure to the energy emitted from the energy source.

The present disclosure further relates to a method that includes surrounding a core of a cable with a first armor wire layer, disposing a first polymer layer around the first armor wire layer, where the first polymer layer has a first sensitivity to energy emitted from an energy source, surrounding a second armor wire layer with a second polymer layer, where the second polymer layer has a second sensitivity to the energy emitted from the energy source, and where the second sensitivity is greater than the first sensitivity, emitting the energy from the energy source toward the first polymer layer and the second polymer layer, such that the second polymer and at least a portion of the first polymer layer melt, directing the second armor wire layer radially inward toward the first polymer layer, such that the second armor wire layer extends into the first polymer layer.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
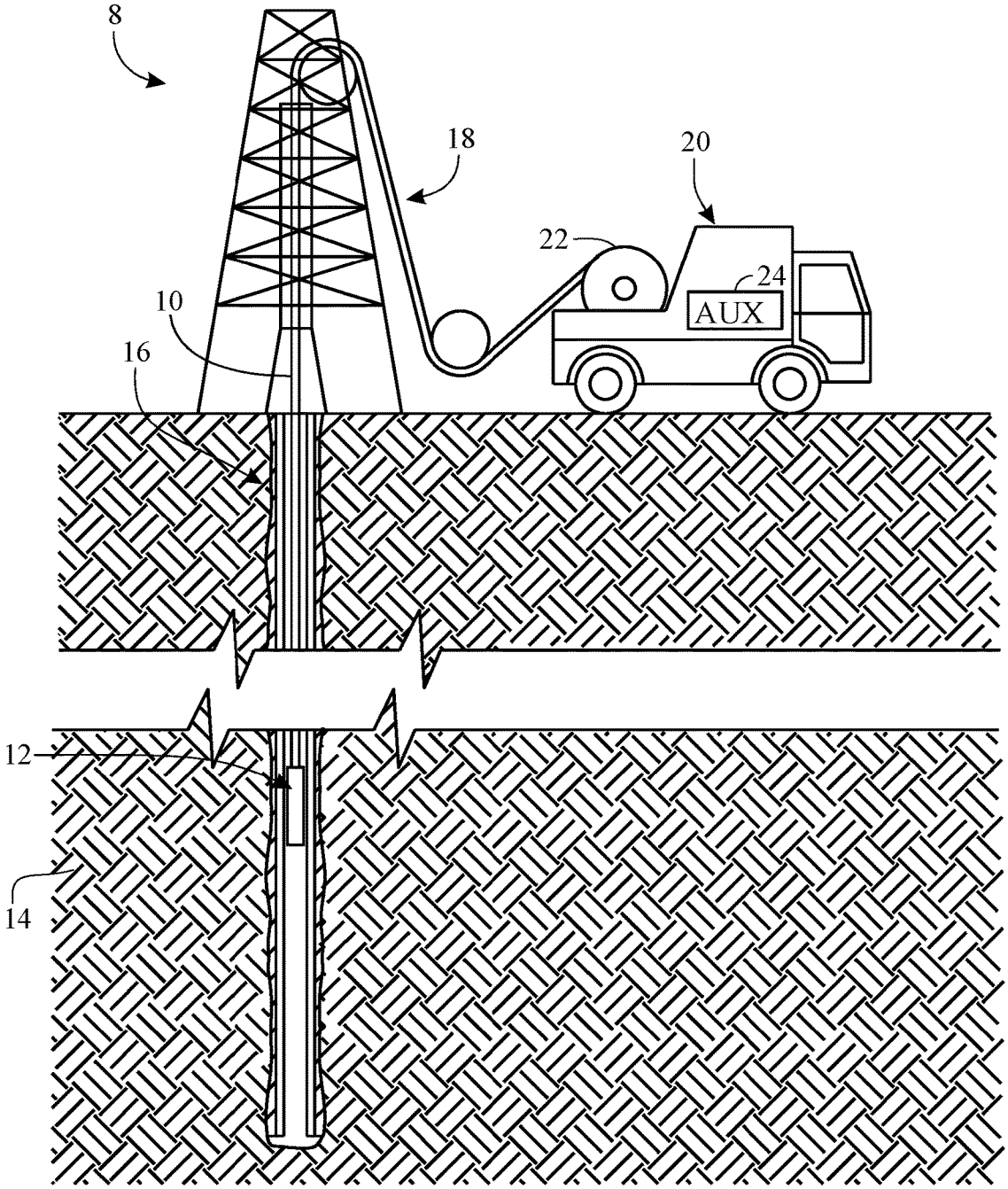
FIG. 1 is a schematic diagram of an embodiment of a well-logging system that may utilize an improved wireline cable, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Wireline cables may be utilized to lower (e.g., run) well-logging tools into a wellbore, such that data related to the wellbore may be collected and monitored to determine well performance. Additionally, the wireline cables may provide electrical connections between the well-logging tools and control systems located at a rig platform (e.g., a surface of a geological formation). The wireline cables may withstand axial forces resulting from a weight of the well-logging tool as well as the wireline cable itself. Accordingly, some wireline cables may include a cable core that establishes the electrical connection between the well-logging tool and a control system, as well as one or more armor wire layers that provide support to the wireline cable (and/or electrical connections to the well-logging tool). The one or more armor wire layers may enable the wireline cable to withstand the axial forces applied to the wireline cable as the well-logging tool is lowered into the wellbore.

Some wireline cables used to lower well-logging tools into a wellbore include polymer jacketing that may encase armor wire layers of the wireline cable in attempt to protect the armor wire layers and enhance the robustness of the wireline cable. Typically, manufacturing processes for such wireline cables may utilize a single type of polymer, with successive layers of jacketing applied under, between and over the armor wire layers. Unfortunately, because the jackets include the same type of polymeric material, layers of the polymer jacketing melt at the same rate. Accordingly, outer armor wire layers may contact inner armor wire layers as the outer armor wire layer extends into a melted polymer jacket layer. When the inner and outer armor wire layers contact one another, interstitial voids may be created between the armor wire layers. Such interstitial voids may create a pathway for gases and/or fluids to infiltrate the wireline cable, thereby reducing the robustness of the wireline cable.

Accordingly, embodiments of the present disclosure relate to an improved wireline cable that includes a first polymer layer surrounding a first armor wire layer (e.g., an inner armor wire layer) and a second polymer layer surrounding a second armor wire layer (e.g., an outer armor wire layer). The first polymer layer and the second polymer layer may include different sensitivities to energy (e.g., infrared radiation) emitted from an energy source. For example, the first polymer layer and the second polymer layer may include different pigment colors, different concentrations of a pigment, or a combination thereof to produce the different sensitivities to the energy. In any case, the first polymer layer may be less sensitive (e.g., less absorptive) than the second polymer layer, such that the second polymer layer melts at a faster rate than the first polymer layer. Accordingly, the first polymer layer may act as a barrier between the first armor wire layer (e.g., the inner armor wire layer) and the second armor wire layer (e.g., the outer armor wire layer) to block the first armor wire layer and the second armor wire layer from contacting one another. In some embodiments, the first polymer layer may include structural features (e.g., protrusions) that melt before a base portion of the first polymer layer. Thus, the second armor wire layer to be coupled to the first polymer layer (e.g., as a result of the melted structural features), but blocked from contacting the first armor wire layer by the base portion, which may remain substantially solidified (e.g., not melted and/or less melted than the protrusions).

With this in mind, FIG. 1 illustrates a well-logging system 8 that may utilize embodiments of a wireline cable 10 described in the present disclosure. The well-logging system 8 may be used to convey a downhole tool 12 through a geological formation 14 via a wellbore 16. The downhole tool 12 may be conveyed on the wireline cable 10 via a logging winch system 20. Although the logging winch system 20 is schematically shown in FIG. 1 as a mobile logging winch system carried by a truck, the logging winch system 20 may be substantially fixed (e.g., a long-term installation that is substantially permanent or modular). In some embodiments, the wireline cable 10 may be spooled and unspooled on a drum 22 and an auxiliary power source 24 may provide electrical energy to the logging winch system 20 and/or the downhole tool 12.

The downhole tool 12 may be any suitable measurement tool that obtains measurements at various depths of the wellbore 16. The downhole tool 12 may be lowered (e.g., disposed or run) into the wellbore 16 using the wireline cable 10. The wireline cable 10 may have a composition and/or structure that reduces the likelihood of formation of interstitial voids inside the wireline cable 10, thereby reducing the likelihood of gas or fluids entering the wireline cable 10, which might otherwise cause structural damage to the wireline cable 10. Indeed, embodiments of the present disclosure relate to an enhanced wireline cable 10 that may reduce or eliminate pockets of gas and/or fluids in the wireline cable 10.

While the present disclosure focuses on the cable 10 being a wireline cable 10 that may run the downhole tool 12 into the wellbore 16 of the well-logging system 8, it should be understood that the cable 10 may be utilized for other functions. For example, the cable 10 of the present disclosure may be used for construction purposes (e.g., cranes) and/or any other process or system that may utilize load bearing cables.

Figure 2:
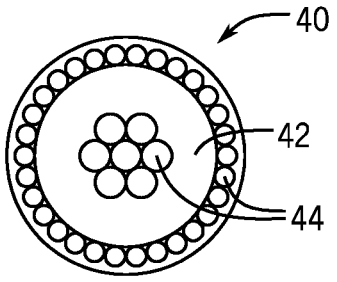
FIG. 2 is cross section of an embodiment of a cable core of the wireline cable, in accordance with an embodiment.

For example, FIG. 2 is a cross section of a cable core 40 (e.g., a core) that may form a center portion 42 of the wireline cable 10. In the illustrated embodiment of FIG. 2, the cable core 40 is a coaxial cable, but other cores may be used in other examples. The cable core 40 may include one or more wires 44 that may carry electrical currents for supplying power to the downhole tool 12 and/or carrying data to and from the downhole tool 12. While the present discussion focuses on the cable core 40 being a coaxial cable, in other embodiments, the cable core 40 may be any suitable cable for establishing an electrical connection between the downhole tool 12 and a control system or the power supply 24 located at a surface of the formation 14 (see, e.g., FIGS. 11-13). For example, the cable core 40 may include a monocable (see FIG. 11), a quadcable (see FIG. 12), a heptacable (see FIG. 13), an electric submersible pump (ESP) cable, seismic cables, permanent monitoring cables, and/or any other suitable cable that may be coupled to the well-logging tool and utilized to supply power and/or to transport data.

Figure 3:
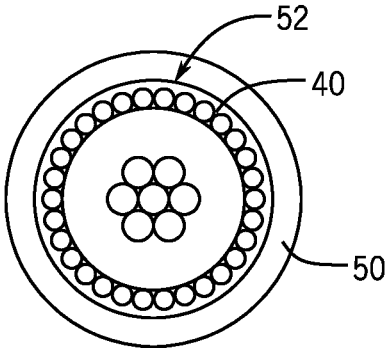
FIG. 3 is a cross section of an embodiment of a first polymer layer extruded over the cable core of FIG. 2, in accordance with an aspect of the present disclosure.

FIG. 3 is a cross section of the cable core 40 of FIG. 2 having a first polymer layer 50 disposed around an exterior surface 52 (e.g., circumference) of the cable core 40. In some embodiments, the first polymer layer 50 may be extruded (e.g., with an extruder) over the exterior surface 52 of the cable core 40, such that the first polymer layer 50 may contact the exterior surface 52 without gaps forming between the exterior surface 52 and the first polymer layer 50. In other embodiments, the first polymer layer 50 may be disposed over the exterior surface 52 of the cable core 40 using another suitable technique. Additionally, while the illustrated embodiment of FIG. 3 shows the first polymer layer 50 as a cylindrical sleeve (e.g., an annular sleeve) disposed over the cable core 40, in other embodiments, the first polymer layer 50 may include another suitable shape and/or structural features (e.g., protrusions) that facilitate construction of the wireline cable 10.

Figure 4:
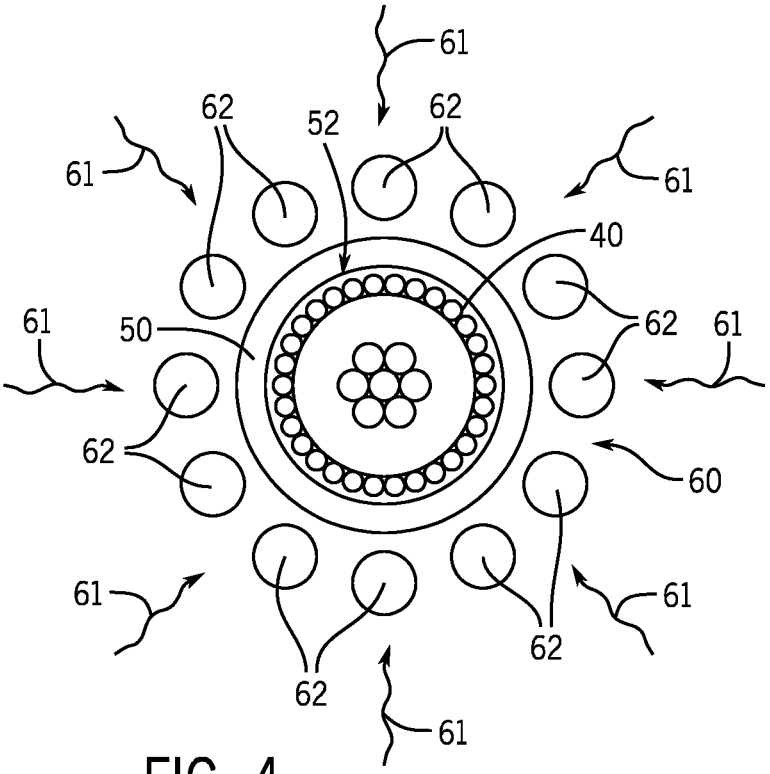
FIG. 4 is a cross section of an embodiment of a first armor wire layer surrounding the first polymer layer of FIG. 3, in accordance with an aspect of the present disclosure.

FIG. 4 is a cross section of an embodiment of the cable core 40, the first polymer layer 50, and a first armor wire layer 60 of the wireline cable 10. The first armor wire layer 60 may be disposed in the first polymer layer 50, and thus surround the exterior surface 52 of the cable core 40, by directing energy 61 (e.g., infrared waves) toward the first armor wire layer 60 and the first polymer layer 50. The energy 61 directed at the first polymer layer 50 may cause the first polymer layer 50 to melt (e.g., soften or at least partially melt). Thus, the first armor wire layer 60 may be directed radially inward toward the first polymer layer 50, such that the first polymer layer 50 causes the first armor wire layer 60 to adhere to the cable core 40. For example, the first armor wire layer 60 may be disposed in the first polymer layer 50 when it is in a melted or softened state. The energy 61 directed at the first polymer layer 50 may be removed, thus causing the first polymer layer 50 to dry or harden. Accordingly, the first armor wire layer 60 may adhere to the cable core 40 via the hardened first polymer layer 50, as shown in FIG. 5.

Figure 5:
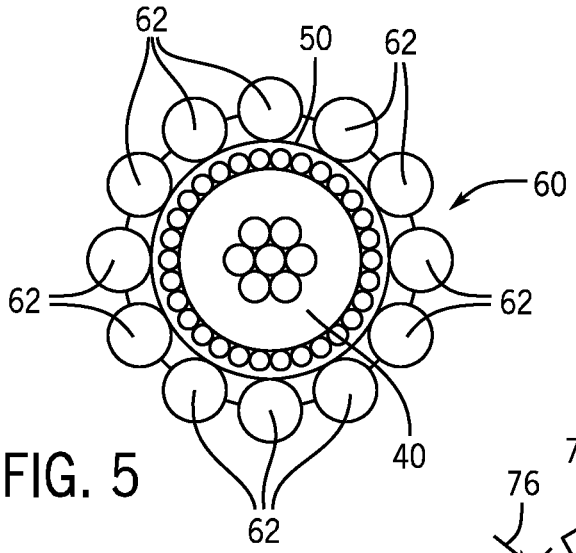
FIG. 5 is a cross section of an embodiment of the first armor wire layer of FIG. 4 disposed in the first polymer layer of FIG. 3, in accordance with an aspect of the present disclosure.

As shown in the illustrated embodiments of FIGS. 4 and 5, the first armor wire layer 60 includes twelve armor wires 62. In other embodiments, the first armor wire layer 60 may include fewer than twelve of the armor wires 62 (e.g., one, two, three, four, five, six, seven, eight, nine, ten, or eleven of the armor wires 62) or more than twelve of the armor wires 62 (e.g., thirteen, fourteen, fifteen, sixteen, seventeen, eighteen, nineteen, twenty, or more of the armor wires 62). Additionally, the armor wires 62 of the first armor wire layer 60 may be equally spaced circumferentially about the first polymer layer 50 and the cable core 40. However, in other embodiments, the armor wires 62 may be non-uniformly spaced circumferentially about the first polymer layer and the cable core 40. When the armor wires 62 are disposed in the first polymer layer 50, each of the armor wires 62 may be isolated from one another. Accordingly, contact between the armor wires 62 may be prevented, such that pockets and/or gaps that enable gas and/or fluids to be entrained in the wireline cable 10 may be substantially eliminated.

The first polymer layer 50 may include a polymeric material such as fluoropolymer, ethylene propylene polymer, ethylene tetrafluoroethylene, a fluorine-based polymer, another suitable virgin or fiber-reinforced polymeric material, or a combination thereof. The first polymer layer 50 may include a first sensitivity to the energy (e.g., infrared waves) directed toward the first polymer layer 50. As discussed in detail below, the first sensitivity of the first polymer layer may depend at least on a color of pigment in the first polymer layer 50 and/or a concentration of the pigment in the first polymer layer 50 (e.g., the higher the concentration, the less resistant the first polymer layer 50 may become to the energy).

As shown in the illustrated embodiment of FIG. 5, the first polymer layer 50 may not completely encase the first armor wire layer 60. In other words, the armor wires 62 of the first armor wire layer 60 may protrude (e.g., extend radially outward) from the first polymer layer 50. However, in other embodiments, the first armor wire layer 60 may be fully encased by the first polymer layer 50 (e.g., the first polymer layer 50 completely surrounds the armor wires 62 of the first armor wire layer 60). In any case, a second polymer layer 70 may be disposed over the first armor wire layer 60 (and thus the first polymer layer 50 and the cable core 40), as shown in FIG. 6. In some embodiments, the second polymer layer 70 may be extruded over the first armor wire layer 60, the first polymer layer 50, and the cable core 40. In other embodiments, the second polymer layer 70 may be disposed around the first armor wire layer 60, the first polymer layer 50, and the cable core 40 using another suitable technique.

Figure 6A:
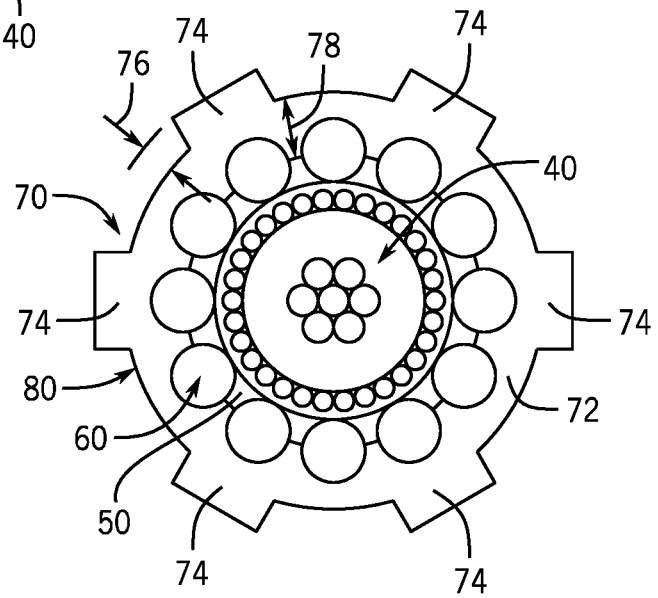
FIGS. 6A-6D are a cross sections of different embodiments of a second polymer layer extruded over the first armor wire layer of FIG. 4, in accordance with an aspect of the present disclosure.

As shown in the illustrated embodiment of FIG. 6, the second polymer layer 70 may include a non-uniform shape, which may include a variety of configurations (e.g., FIGS. 6A-6D). For example, FIG. 6A is a cross section of an embodiment of the second polymer layer 70 disposed around the first armor wire layer 60, the first polymer layer 50, and the cable core 40. The second polymer layer 70 includes a base portion 72 and one or more protrusions 74. The base portion 72 of the second polymer layer 70 may be positioned closer to the first armor wire layer 60 when compared to the protrusions. In other words, the protrusions 74 may extend radially outward from the base portion 72.

Accordingly, the protrusions 74 may be exposed to the energy 61 (e.g., infrared waves) before the base portion 72 when a second armor wire layer (see FIG. 7) is to be disposed around (and/or at least partially within) the second polymer layer 70 (e.g., the second polymer layer may at least partially adhere to the second armor wire layer to couple the second armor wire layer to the wireline cable 10). Accordingly, the protrusions 74 may melt before the base portion 72. In some embodiments, the protrusions 74 may melt upon exposure to the energy 61 (e.g., infrared waves), but the base portion 72 may not melt, such that the base portion 72 acts as a barrier between the first armor wire layer 60 and the second armor wire layer (see FIG. 7). Blocking the second armor wire layer from extending into the base portion 72 of the second polymer layer 70 may substantially prevent contact between the first armor wire layer 60 and the second armor wire layer, which may ultimately block the formation of pockets or gaps that may trap gas and/or fluids in the wireline cable 10.

The second polymer layer 70 may include a polymeric material such as fluoropolymer, ethylene propylene polymer, ethylene tetrafluoroethylene, a fluorine-based polymer, another suitable virgin or fiber-reinforced polymeric material, or a combination thereof. The second polymer layer 70 may include a second sensitivity to the energy 61 (e.g., infrared waves) that may be ultimately directed toward the second polymer layer 70. The second sensitivity of the second polymer layer 70 may depend at least on a color of pigment in the second polymer layer 70 and/or a concentration of the pigment in the second polymer layer 70 (e.g., the higher the concentration, the less resistant the second polymer layer 70 may become to the energy). The second sensitivity of the second polymer layer 70 is discussed in more detail herein with reference to FIG. 7.

In the illustrated embodiment of FIG. 6A, the second polymer layer 70 may include six of the protrusions 74 that are rectangular-shaped. The rectangular-shaped protrusions 74 may extend a distance 76 from the base portion 72. For example, in some embodiments, the distance 76 may be between 0.001 millimeters (mm) and 1 mm, between 0.01 mm and 0.2 mm (e.g., when the pigment color and/or pigment concentration of the second polymer layer 70 causes the second polymer layer 70 to be less sensitive than a third polymer layer), or between 0.02 mm and 0.1 mm (e.g., when the pigment color and/or pigment concentration of the second polymer layer 70 causes the second polymer layer 70 to be less sensitive than the third polymer layer). In other embodiments, the distance 76 may be between 5% and 200% of a thickness 78 of the base portion 72, between 10% and 110% of the thickness 78 of the base portion 72 (e.g., when the pigment color and/or pigment concentration of the second polymer layer 70 causes the second polymer layer 70 to be less sensitive than the third polymer layer), or between 25% and 100% of the thickness 78 of the base portion 72 (e.g., when the pigment color and/or pigment concentration of the second polymer layer 70 causes the second polymer layer 70 to be less sensitive than the third polymer layer). The protrusions 74 of the second polymer layer 70 shown in FIG. 6A do not cover an entire circumference 80 of the base portion 72. In some embodiments, the protrusions 74 may cover between 20% and 100% of the circumference 80 of the base portion 72 (indeed, when the protrusions 74 cover the entire surface of the base portion 72, the protrusions 74 may melt more quickly than the base portion 72), between 30% and 90% of the circumference 80 of the base portion 72, or between 50% and 80% of the circumference 80 of the base portion 72. In other embodiments, the protrusions 74 may cover at least 20% of the circumference 80 of the base portion 72. In some embodiments, the protrusions 74 may not be present.

Figure 6B:
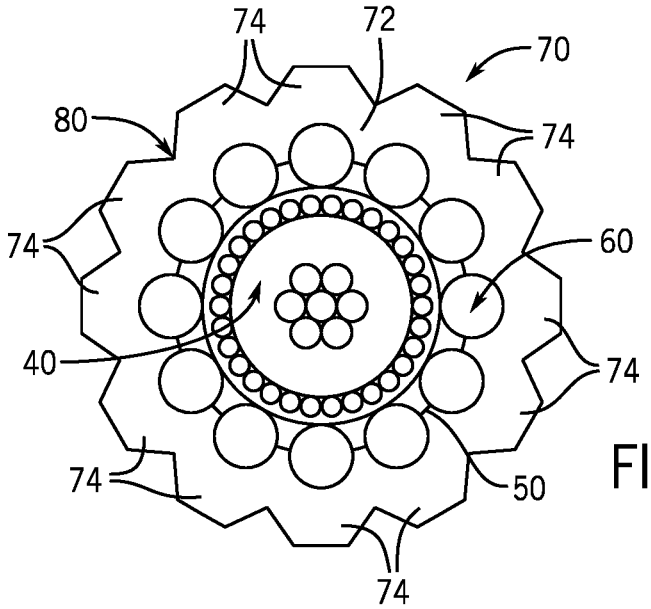
Figure 6C:
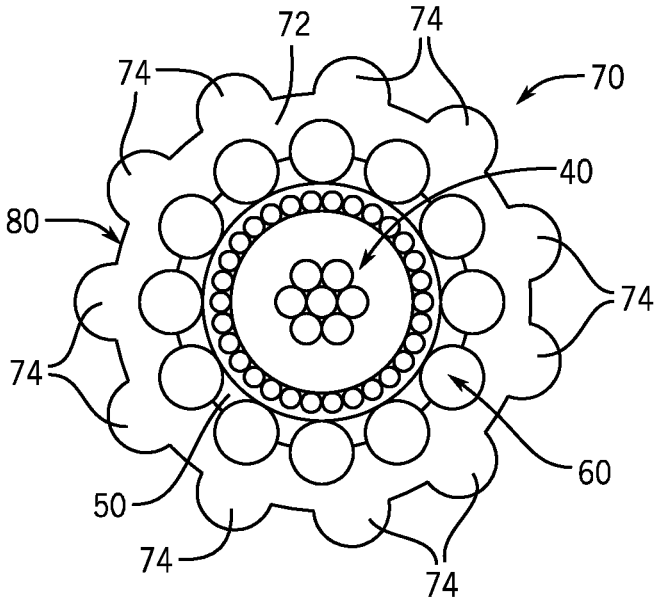
Figure 6D:
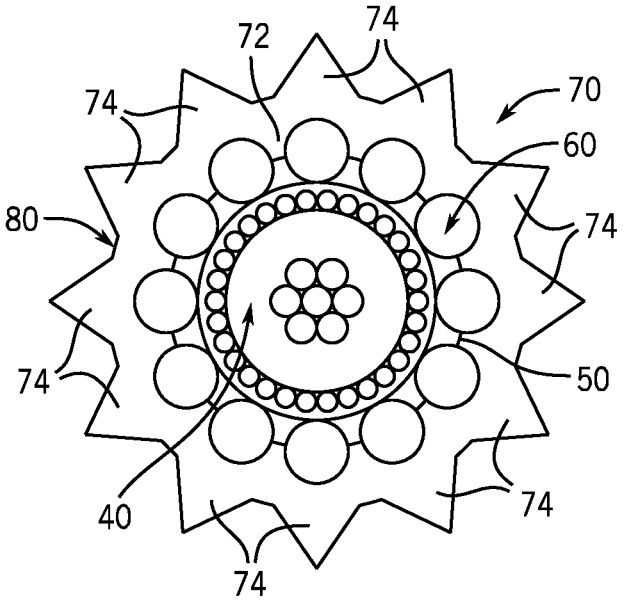

Additionally, in other embodiments, the protrusions 74 of the second polymer layer 70 may not be rectangular-shaped, as shown in FIGS. 6B-6D. For example, FIG. 6B is a cross section of another embodiment of the second polymer layer 70 disposed over the first armor wire layer 60, the first polymer layer 50, and the cable core 40. The protrusions 74 of the second polymer layer 70 of FIG. 6B are polygon-shaped (e.g., trapezoids, pentagons, hexagons, heptagons, octagons, etc.). As shown in the illustrated embodiment of FIG. 6B, the protrusions 74 cover approximately 100% of the circumference of the base portion 72. However, in other embodiments, the protrusions 74 may cover any appropriate amount of the base portion 72, as discussed with respect to FIG. 6A. Additionally, as discussed above, the protrusions 74 may be equally spaced circumferentially about the base portion 72 or non-uniformly spaced circumferentially about the base portion 72. Further, while the illustrated embodiment of FIG. 6B shows the second polymer layer 70 having twelve of the protrusions 74, the second polymer layer 70 may include any suitable number of the protrusions 74 (e.g., one, two, three, four, five, six, seven, eight, nine, ten, eleven, thirteen, or more of the protrusions 74).

Additionally, FIG. 6C is a cross section of another embodiment of the second polymer layer 70 disposed over the first armor wire layer 60, the first polymer layer 50, and the cable core 40. The protrusions 74 of the second polymer layer 70 of FIG. 6C are semi-circles. However, it should be understood that the protrusions 74 may also be substantially circular protrusions extending from the base portion 72 of the second polymer layer 70. As shown in the illustrated embodiment of FIG. 6C, the protrusions 74 cover approximately 80% of the circumference of the base portion 72. However, in other embodiments, the protrusions 74 may cover any appropriate amount of the base portion 72, as discussed with respect to FIG. 6A. Additionally, as discussed above, the protrusions 74 may be equally spaced circumferentially about the base portion 72 or non-uniformly spaced circumferentially about the base portion 72. Further, while the illustrated embodiment of FIG. 6C shows the second polymer layer 70 having eleven of the protrusions 74, the second polymer layer 70 may include any suitable number of the protrusions 74 (e.g., one, two, three, four, five, six, seven, eight, nine, ten, twelve, or more of the protrusions 74).

Furthermore, FIG. 6D is a cross section of another embodiment of the second polymer layer 70 disposed over the first armor wire layer 60, the first polymer layer 50, and the cable core 40. The protrusions 74 of the second polymer layer 70 of FIG. 6D are triangular-shaped. As shown in the illustrated embodiment of FIG. 6C, the protrusions 74 cover approximately 90% of the circumference of the base portion 72. However, in other embodiments, the protrusions 74 may cover any appropriate amount of the base portion 72, as discussed with respect to FIG. 6A. Additionally, as discussed above, the protrusions 74 may be equally spaced circumferentially about the base portion 72 or non-uniformly spaced circumferentially about the base portion 72. Further, while the illustrated embodiment of FIG. 6D shows the second polymer layer 70 having twelve of the protrusions 74, the second polymer layer 70 may include any suitable number of the protrusions 74 (e.g., one, two, three, four, five, six, seven, eight, nine, ten, eleven, thirteen, or more of the protrusions 74).

It should be noted that FIGS. 6A-6D are intended to provide examples of the non-uniform configuration of the second polymer layer 70. Accordingly, the second polymer layer 70 may include the base portion 72 as well as the protrusions 74 that include any suitable shape, spacing, and/or amount, which enables a second armor wire layer 90 to be coupled to the second polymer layer 70 without extending into the base portion 72. For example, FIG. 7 is a cross section of an embodiment of the second armor wire layer 90 disposed around the second polymer layer 70, the first armor wire layer 60, the first polymer layer 50, and/or the cable core 40.

Figure 7:
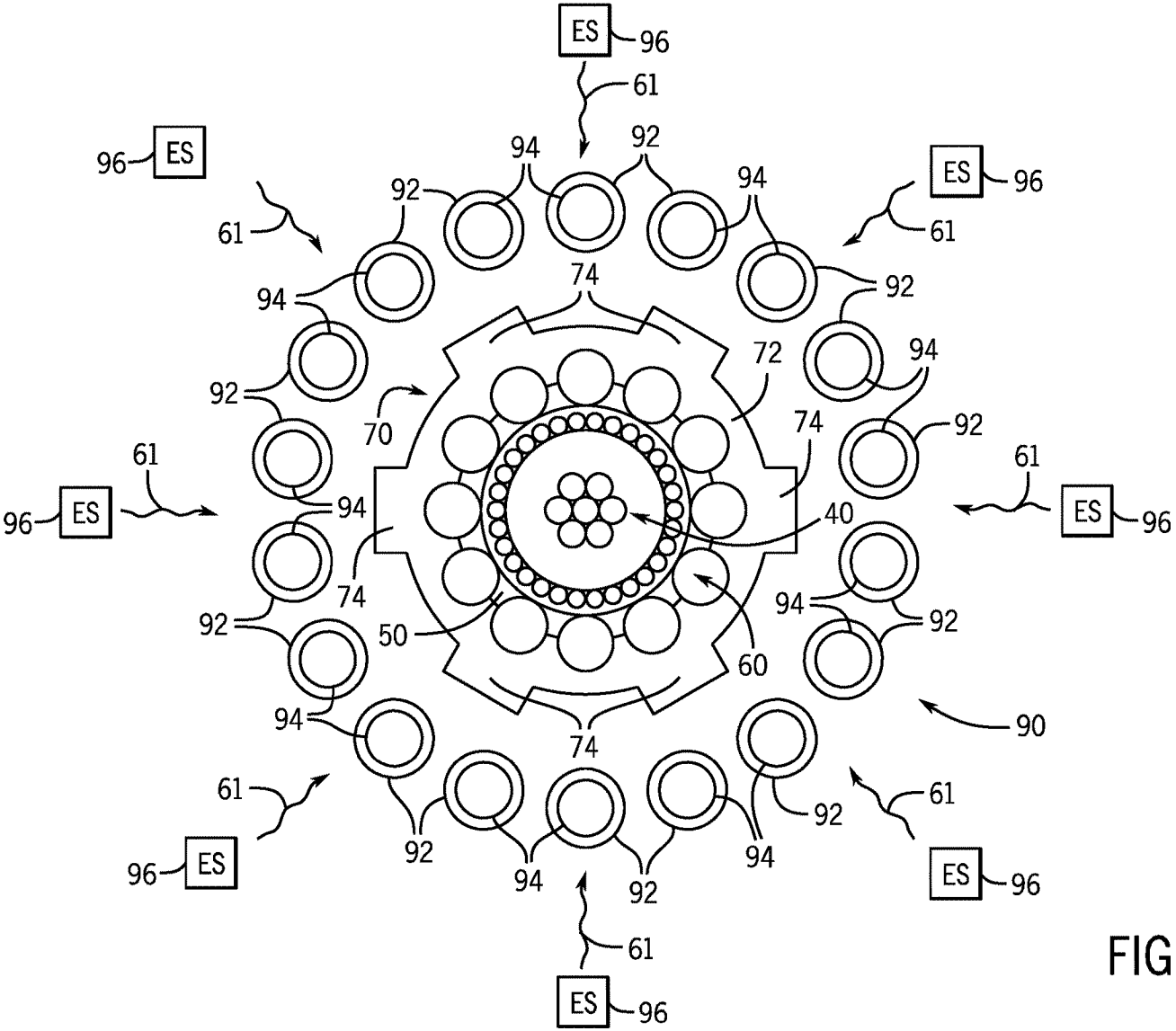
FIG. 7 is a cross section of an embodiment of a second armor wire layer having a third polymer layer surrounding the second polymer layer of FIGS. 6A-6D, in accordance with an aspect of the present disclosure.

As shown in the illustrated embodiment of FIG. 7, the second armor wire layer 90 may include a third polymer layer 92 that encases each second armor wire 94 of the second armor wire layer 90 (e.g., the third polymer layer 92 is disposed around the second armor wire layer 90). As discussed in detail below, the third polymer layer 92 may include a third sensitivity to the energy 61 (e.g., infrared waves) that may also be directed toward the third polymer layer 92. The second armor wire layer 90 of FIG. 7 includes eighteen of the second armor wires 94, however, in other embodiments, the second armor wire layer 90 may include fewer than eighteen of the second armor wires 94 (e.g., 1, 2, 3, 4, 5, 6, 7, 8, 9, 10, 11, 12, 13, 14, 15, 16, or 17 of the second armor wires 94) or more than eighteen of the second armor wires 94 (e.g., 19, 20, 21, 22, 23, 24, 25, 26, 27, 28, 29, 30, or more of the second armor wires 94).

As shown in FIG. 7, an energy source 96 (e.g., an infrared light source) may direct the energy 61 (e.g., infrared waves) toward the second armor wire layer 90. The third polymer layer 92 disposed around each of the second armor wires 94 of the second armor wire layer 90 may be exposed to the energy 61 before the second polymer layer 70 because the third polymer layer 92 is positioned radially outward from the second polymer layer 70. Accordingly, the third polymer layer 92 may begin to melt before the protrusions 74 of the second polymer layer 70.

Furthermore, the sensitivities of the second polymer layer 70 and the third polymer layer 92 may be different from one another. In other words, the second polymer layer 70 and the third polymer layer 92 may absorb different amounts of the energy 61 based on differences between characteristics (e.g., pigment color and/or concentrations of pigments) of the second polymer layer 70 and the third polymer layer 92. For example, polymeric materials that include different pigments, or different concentrations of the same pigment, may include different sensitivities to the energy 61 (e.g., infrared waves) directed at the polymeric material (e.g., the pigments and concentrations of the pigment may determine how much of the energy 61 is absorbed by the polymer layers). Accordingly, it may be desirable to form the wireline cable 10 where the second polymer layer 70 is less sensitive to the energy 61 than the third polymer layer 92. Therefore, the third polymer layer 92 may have a first melt rate that is greater (e.g., faster) than a second melt rate of the second polymer layer 70, such that the third polymer layer 92 melts faster than the second polymer layer 70 upon substantially the same exposure to the energy 61. Such a configuration may enable the base portion 72 of the second polymer layer 70 to remain substantially solidified (e.g., not melted) and block contact between the first armor wire layer 60 and the second armor wire layer 90.

In some embodiments, the energy 61 may be infrared waves, and thus, the third polymer layer 92 may include a first pigment that is more sensitive to infrared waves than a second pigment of the second polymer layer 70 (e.g., in accordance with an infrared light spectrum). For example, some colors along the infrared light spectrum from most sensitive (e.g., most absorptive) to least sensitive (e.g., least absorptive) include red, orange, green, blue, and purple. Accordingly, in some embodiments, the third polymer layer 92 may include a red pigment whereas the second polymer layer 70 may include a green pigment. In other embodiments, the third polymer layer 92 may include an orange pigment and the second polymer layer 70 may include a blue pigment. Additionally, in some embodiments, the third polymer layer 92 may include a green pigment and the second polymer layer 70 may include a purple pigment. In still further embodiments, the third polymer layer 92 and the second polymer layer 70 may include any suitable combination of pigment colors.

Further, the concentration of the pigment in the third polymer layer 92 and the second polymer layer 70 may affect the sensitivities of the third polymer layer 92 and the second polymer layer 70. For example, in some embodiments, including a higher concentration of pigment in the third polymer layer 92 and/or the second polymer layer 70 may increase a sensitivity of the third polymer layer 92 and/or the second polymer layer 70. Accordingly, in some embodiments, the third polymer layer 92 and the second polymer layer 70 may include the same color pigment at different concentrations (e.g., the third polymer layer 92 includes a higher concentration of the pigment than the second polymer layer 70).

Additionally or alternatively, the combination of pigment colors between the third polymer layer 92 and the second polymer layer 70 may be based on a first concentration of a first pigment color in the third polymer layer 92 and a second concentration of a second pigment color in the second polymer layer 70. As a non-limiting example, the third polymer layer 92 may include an orange pigment as the first pigment color at a relatively high concentration and the second polymer layer 70 may include green as the second pigment color at a relatively low concentration. Even though orange and green are close to one another along the infrared spectrum, the concentration of the pigments in the third polymer layer 92 and the second polymer layer 70 may enable such color pigments to be utilized. Therefore, it should be understood that any suitable combination of pigment colors and concentrations may be selected, such that the third polymer layer 92 includes a higher sensitivity to the energy 61 than the second polymer layer 70.

While the sensitivities of the second polymer layer 70 and the third polymer layer 92 may be different from one another, the third polymer layer 92 may still include the same polymeric material as the second polymer layer 70, but with a different color pigment or a different concentration of pigment. For example, the third polymer layer 92 may include a polymeric material such as fluoropolymer, ethylene propylene polymer, ethylene tetrafluoroethylene, a fluorine-based polymer, another suitable virgin or fiber-reinforced polymeric material, or a combination thereof.

When the energy 61 is directed to the second armor wire layer 90 and the second polymer layer 70, the third polymer layer 92 may melt at a faster rate than the second polymer layer 70. Therefore, the third polymer layer 92 surrounding each of the second armor wires 94 of the second armor wire layer 90 may melt before the second polymer layer 70 (e.g., the protrusions 74 of the second polymer layer 70). Additionally, as discussed above, the protrusions 74 of the second polymer layer 70 may begin melting before the base portion 72 of the second polymer layer 70 because the protrusions 74 extend radially outward from the base portion 72 toward the energy source 96. However, the base portion 72 of the second polymer layer 70 may remain substantially solidified (e.g., not melt). The base portion 72 may remain substantially solidified because the second polymer layer 70 includes a pigment color (or pigment concentration) that is less sensitive (e.g., less absorptive) to the energy 61 than the third polymer layer 92 and because the protrusions 74 absorb the energy 61 before the base portion 72. Therefore, the base portion 72 may act as a barrier that blocks contact between the first armor wire layer 60 and the second armor wire layer 90.

Figure 8:
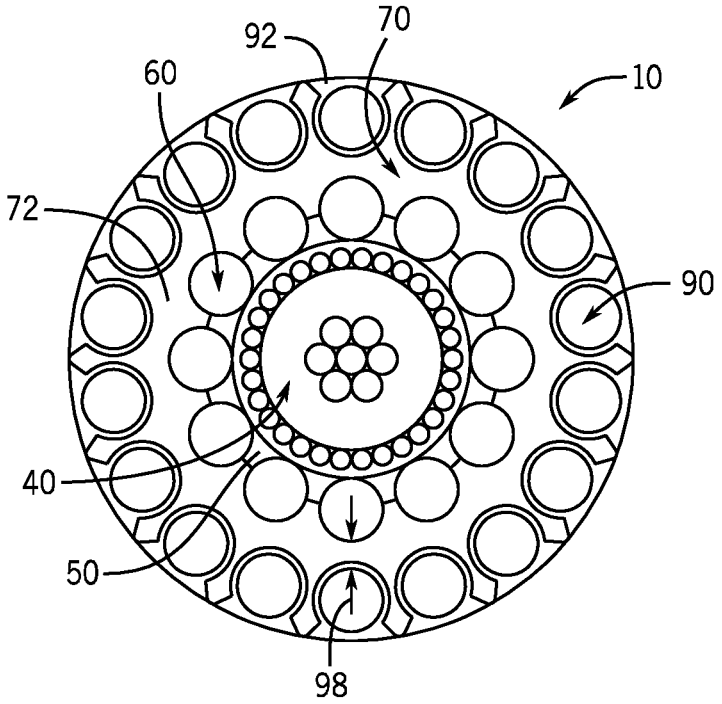
FIG. 8 is a cross section of an embodiment of the second armor wire layer of FIG. 7 disposed at least partially in the second polymer layer of FIGS. 6A-6D, in accordance with an aspect of the present disclosure.

FIG. 8 is a cross section of the wireline cable 10 when the second armor wire layer 90 is disposed into the second polymer layer 70 (e.g., the protrusions 74 of the second polymer layer 70). As shown in the illustrated embodiment of FIG. 8, the second armor wire layer 90 is encased by a combination of the second polymer layer 70 and the third polymer layer 92. Further, the second armor wire layer 90 is isolated from the first armor wire layer 60 by the base portion 72 of the second polymer layer 70 (e.g., a distance 98 separates the first armor wire layer 60 from the second armor wire layer 90). Accordingly, pockets and/or gaps that may enable gas and/or fluids to be entrained in the wireline cable 10 may be eliminated. Additionally, the second polymer layer 70 and the third polymer layer 92 may isolate each of the second armor wires 94 from one another. Blocking contact between the second armor wires 94 may also prevent pockets and/or gaps that enable gas and/or fluids to be entrained in the wireline cable 10. Further, because the third polymer layer 92 melts at a faster rate than the second polymer layer 70, the third polymer layer 92 may fill any gaps between the second armor wire layer 90 and the second polymer layer 70. The second armor wire layer 90 may adhere to (e.g., couple to) the second polymer layer 70 as a result of both the third polymer layer 90 melting as well as the protrusions 74 of the second polymer layer 70 at least partially melting. For example, when the energy 61 is directed at the second armor wire layer 90, the third polymer layer 92, and the second polymer layer 70, the third polymer layer 92 may melt first (e.g., fastest). The protrusions 74 of the second polymer layer 70 may also at least partially melt, thereby enabling the second armor wire layer 90 to be directed radially inward toward the second polymer layer 70. The energy source 96 may be removed, such that the second polymer layer 70 and the third polymer layer 92 solidify (e.g., harden) and couple the second armor wire layer 90, the third polymer layer 92, and the second polymer layer 70 to one another.

In some embodiments, the combination of the cable core 40, the first polymer layer 50, the first armor wire layer 60, the second polymer layer 70, the second armor wire layer 90, and the third polymer layer 92 may form a substantially cylindrical structure that includes a circular cross-section (e.g., as shown in FIG. 8). To form the cylindrical structure, the wireline cable 10 may pass through shaping rollers when the second polymer layer 70 and the third polymer 92 dry (e.g., harden), such that the wireline cable 10 is shaped to include the cylindrical structure with a circular cross-section. In other embodiments, the wireline cable 10 may include another suitable structure that includes a different cross sectional shape (e.g., square, rectangular, polygonal, etc.). In still further embodiments, the cross section of the wireline cable 10 may be non-uniform throughout a length of the wireline cable 10.

Figure 9:
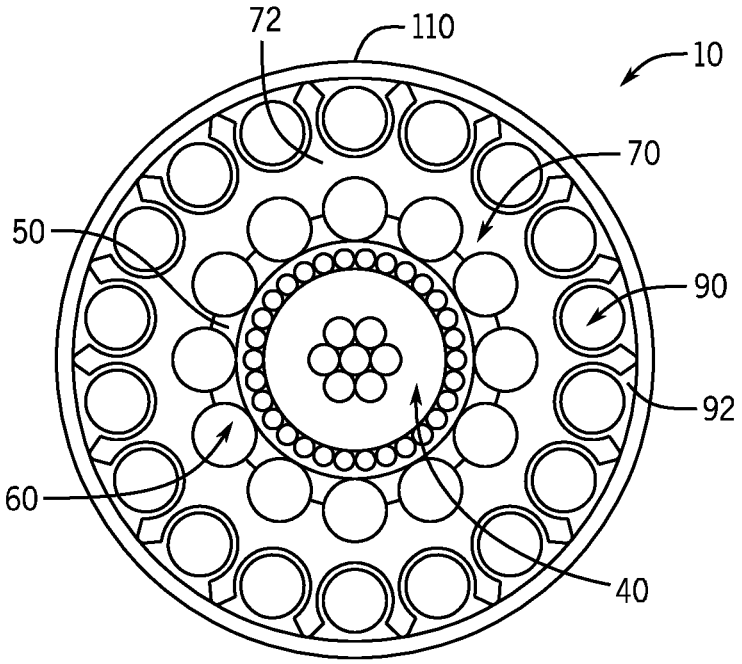
FIG. 9 is a cross section of an embodiment of a fourth polymer layer extruded over the second armor wire layer of FIG. 7, in accordance with an aspect of the present disclosure.

Additionally, to provide further protection to the wireline cable 10, a fourth polymer layer 110 may be disposed over the third polymer layer 92, as shown in FIG. 9. The fourth polymer layer 110 may be extruded over the third polymer layer 92 to form the complete wireline cable 10. In some embodiments, the fourth polymer layer 110 may include a virgin carbon fiber reinforced polymeric material. In other embodiments, the fourth polymer layer 110 may include any suitable polymeric material that may provide further protection to the wireline cable.

Figure 10:
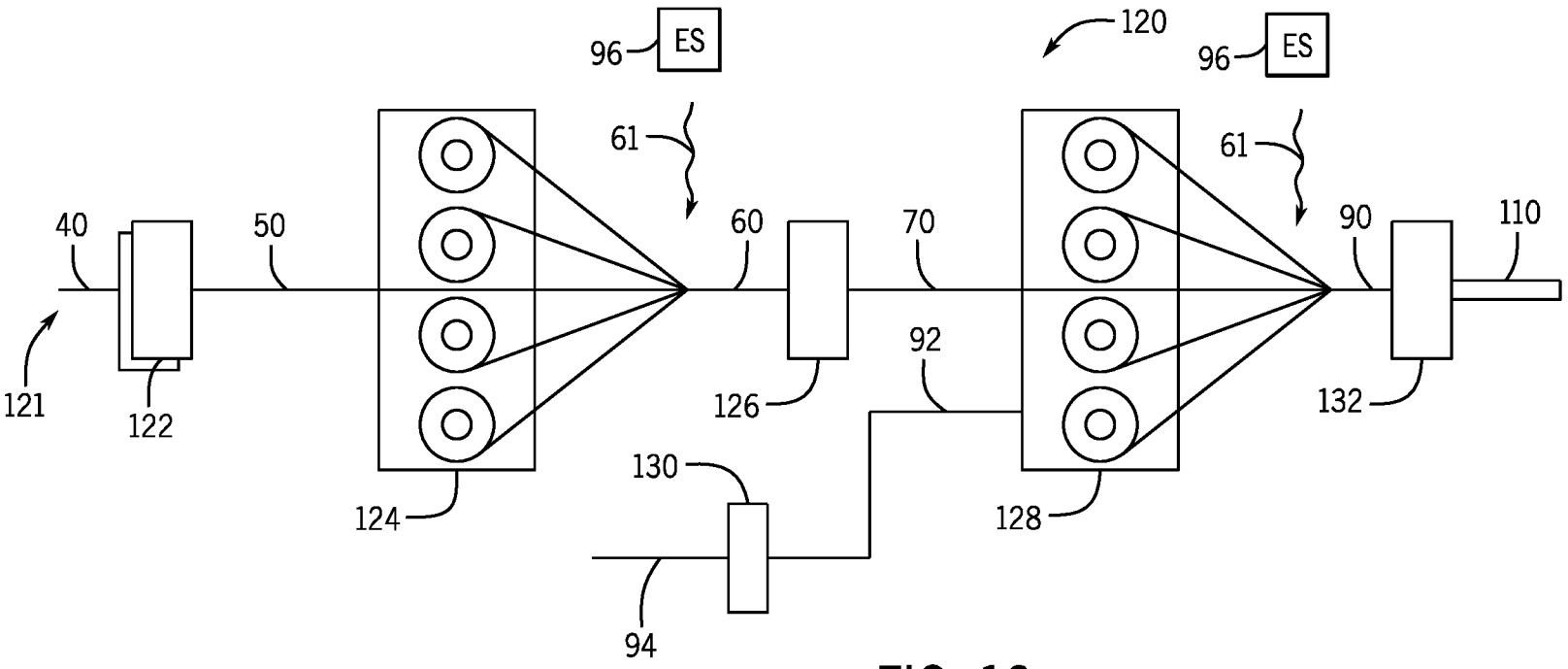
FIG. 10 is a schematic of a manufacturing line for the wireline cable, in accordance with an aspect of the present disclosure.

FIG. 10 is a schematic diagram of a cable manufacturing line 120 that may be utilized to generate the wireline cable 10. For example, the cable core 40 may enter the cable manufacturing line 120 at an input 121 of the cable manufacturing line 120. The first polymer layer 50 may then be extruded over the cable core 40 in a first extrusion station 122. The first polymer layer 50 may provide consistent embedding of the first armor wire layer 60 into the wireline cable 10. In some embodiments, the cable core 40 may be encased with layers of both hard and soft polymers (e.g., the first polymer layer 50 includes at least two layers of polymeric material). For example, a hard layer of the first polymer layer 50 may be placed beneath a soft layer of the first polymer layer 50, such that the first armor wire layer 60 may be blocked from extending into the cable core 40 through the first polymer layer 50.

The first armor wire layer 60 is cabled helically over and embedded into the first polymer layer 50 at a first armoring station 124. While armoring, the energy source 96 may emit the energy 61 (e.g., infrared waves) to melt the first polymer layer 50 and enable the first armor wire layer 60 to be coupled to the cable core 40. Additionally, the second polymer layer 70 may be extruded over the first armor wire layer 60 at a second extrusion station 126.

The second armor wire layer 90 may then be cabled (e.g., rotated in a same circumferential direction as the first armor wire layer 60 or rotated in an opposite circumferential direction as the first armor wire layer 60) over and embedded into the second polymer layer 70 at a second armoring station 128. Additionally, the third polymer layer 92 may be extruded over the second armor wires 94 of the second armor wire layer 90 at a third extrusion station 130 that is upstream of the second armoring station 128. While cabling the second armor wire layer 90, the energy source 96 may direct the energy 61 (e.g., infrared waves, ultrasonic waves, and/or microwaves) at the second polymer layer 70 (e.g., the protrusions 74), the second armor wire layer 90, and the third polymer layer 92 to melt the third polymer layer 92 and at least partially melt the protrusions 74 of the second polymer layer 70. Accordingly, the second armor wire layer 90 may be coupled to the first armor wire layer 60 and the cable core 40. Additionally, the fourth polymer layer 110 may be extruded over the second armor wire layer 90 and/or the third polymer layer at a fourth extrusion station 132 to complete the wireline cable 10 as described above.

Figure 11:
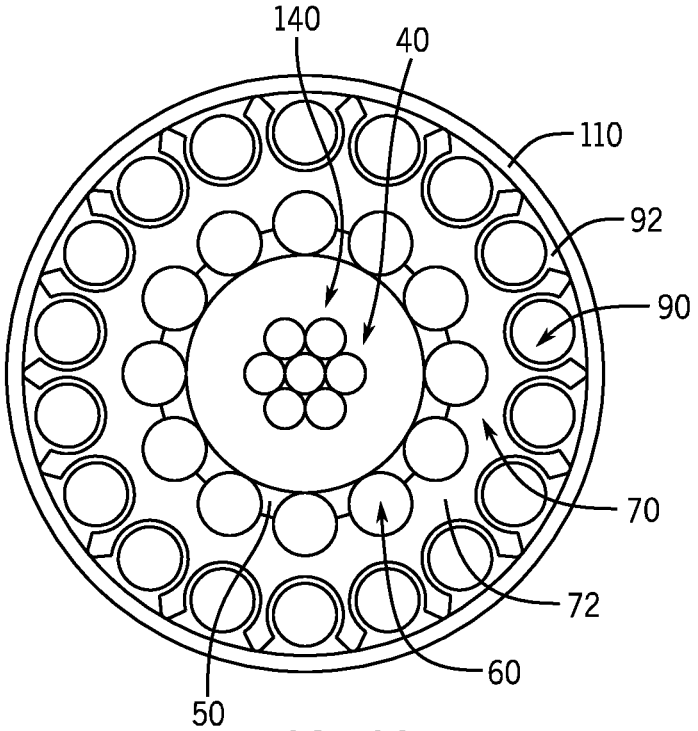
FIG. 11 is a cross section of an embodiment of the wireline cable that includes a monocable as the cable core, in accordance with an aspect of the present disclosure.
Figure 12:
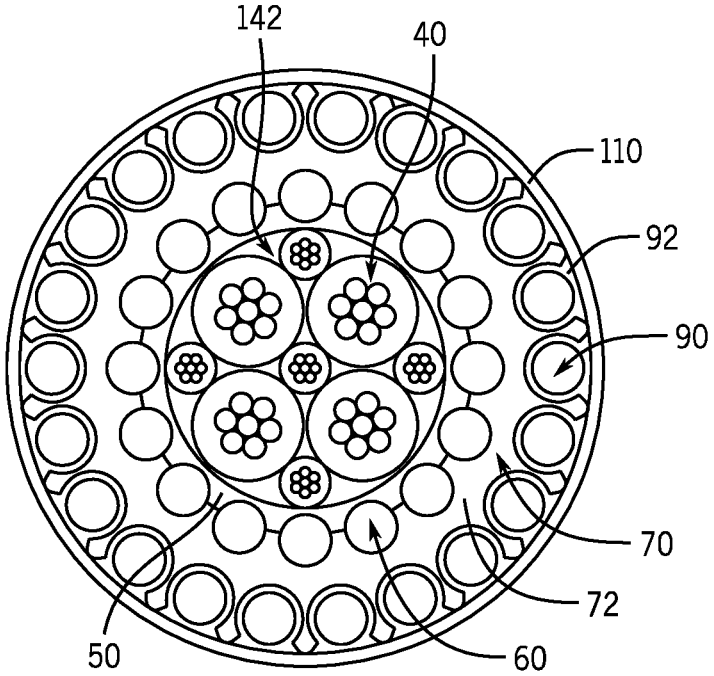
FIG. 12 is a cross section of an embodiment of the wireline cable that includes a quadcable as the cable core, in accordance with an aspect of the present disclosure.
Figure 13:
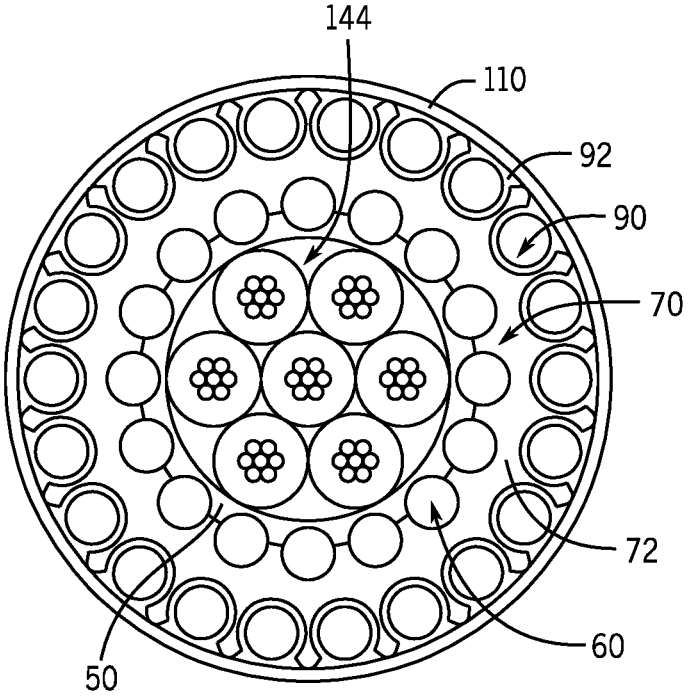
FIG. 13 is a cross section of an embodiment of the wireline cable that includes a heptacable as the cable core, in accordance with an aspect of the present disclosure.

As discussed above, the wireline cable 10 may include any suitable cable core 40 that may be coupled to the downhole tool 12. For example, FIGS. 11-13 are cross sections of embodiments of the wireline cable 10 that include different cable cores 40. For example, FIG. 11 is a cross section of an embodiment of the wireline cable 10 that includes a monocable 140 as the cable core 40. FIG. 12 is a cross section of another embodiment of the wireline cable 10 that includes a quadcable 142 as the cable core 40. Additionally, FIG. 13 is a cross section of yet another embodiment of the wireline cable 10 that includes a heptacable 144 as the cable core 40. Regardless of what is used as the cable core 40, the other components of the wireline cable 10 described above may be utilized to form the wireline cable 10.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A cable, comprising:

a core;

a first insulating jacket disposed around the core and having a first pigment with a first heating sensitivity greater than a heating sensitivity of a virgin non-pigmented polymeric material;

a first armor wire layer disposed around the first insulating jacket;

a second insulating jacket disposed around the first armor wire layer and having a second pigment with a second heating sensitivity greater than the sensitivity of the virgin non-pigmented polymeric material;

a second armor wire layer disposed around the second insulating jacket, each armor wire of the second armor wire layer having a third insulating jacket disposed thereon where the third insulating jacket has a third pigment with a third heating sensitivity greater than the second heating sensitivity of the second insulating jacket; and an outer jacket disposed over the second armor wire layer.

2. The cable of claim 1, wherein the first pigment and the second pigment are the same with different concentrations.

3. The cable of claim 2, wherein the second pigment and the third pigment are the same with different concentrations.

4. The cable of claim 1, wherein the first polymer layer is disposed in any gaps between each armor wire of the first armor wire layer and between each armor wire of the first armor wire layer and the core.

5. The cable of claim 1, wherein the third insulating jacket of each armor wire of the second armor wire layer is bonded to the second insulating jacket.

6. The cable of claim 5, wherein the third insulating jacket of each armor wire of the second armor wire layer is bonded to the outer jacket.

7. The cable of claim 1, wherein the third insulating jacket of each armor wire of the second armor wire layer is disposed in any gaps between the second insulating jacket and each armor wire of the second armor wire layer and between each armor wire of the second armor wire layer and the outer jacket.

8. The cable of claim 4, wherein the first polymer layer is configured to melt from exposure to energy emitted from an energy source to fill the gaps between each armor wire of the first armor wire layer and between each armor wire of the first armor wire layer and the core.

9. The cable of claim 7, wherein the third insulating jacket of each armor wire of the second armor wire layer is configured to melt from exposure to energy emitted from an energy source to fill the gaps between the second insulating jacket and each armor wire of the second armor wire layer and between each armor wire of the second armor wire layer and the outer jacket.

* * * * *